US005882006A

United States Patent [19]

Bell

[11] Patent Number: 5,882,006

[45] Date of Patent: Mar. 16, 1999

[54] APPARATUS AND METHOD FOR TURNING AND ORIENTING ARTICLES WITHIN AN ARTICLE PATHWAY

[75] Inventor: David L. Bell, Oquawka, Ill.

[73] Assignee: Baldwin Technology Corporation, Rosemont, Ill.

[21] Appl. No.: 715,544

[22] Filed: Sep. 30, 1996

Related U.S. Application Data

[63] Continuation-in-part of Ser. No. 539,836, Oct. 6, 1995, Pat. No. 5,695,185.

[51] Int. Cl.[6] ..... B65H 29/00

[52] U.S. Cl. ..... 271/186

[58] Field of Search ..... 271/225, 185, 271/186

[56] References Cited

U.S. PATENT DOCUMENTS

| | | | |
|---|---|---|---|
| 2,823,788 | 2/1958 | Chase . | |
| 3,604,316 | 9/1971 | Labombarde . | |
| 3,717,075 | 2/1973 | Lopez . | |
| 3,758,104 | 9/1973 | Daily . | |
| 3,897,945 | 8/1975 | Faltot et al. . | |
| 3,980,296 | 9/1976 | Craft et al. . | |
| 4,019,435 | 4/1977 | Davis . | |
| 4,085,839 | 4/1978 | Crawford . | |
| 4,160,500 | 7/1979 | Vermehren . | |
| 4,245,734 | 1/1981 | Deutschlander et al. . | |
| 4,277,060 | 7/1981 | Perobelli et al. | 271/186 |
| 4,280,690 | 7/1981 | Hill . | |
| 4,302,001 | 11/1981 | Liepert . | |
| 4,349,188 | 9/1982 | Young . | |
| 4,445,679 | 5/1984 | Bay . | |
| 4,477,066 | 10/1984 | Fischer et al. . | |
| 4,482,147 | 11/1984 | Hibi et al. . | |
| 4,500,086 | 2/1985 | Garavuso . | |
| 4,527,792 | 7/1985 | Burkhardt . | |
| 4,546,702 | 10/1985 | Dorow . | |
| 4,552,068 | 11/1985 | Bernauer et al. . | |
| 4,566,582 | 1/1986 | Linder . | |
| 4,572,350 | 2/1986 | Besemann . | |
| 4,607,743 | 8/1986 | Elam . | |
| 4,696,464 | 9/1987 | Gammerler . | |
| 4,724,945 | 2/1988 | Martin . | |
| 4,756,521 | 7/1988 | Martin . | |
| 4,830,356 | 5/1989 | Zoltner . | |
| 4,877,234 | 10/1989 | Mandel . | |
| 4,879,571 | 11/1989 | Plasscheart . | |
| 4,927,133 | 5/1990 | Evans . | |
| 4,928,807 | 5/1990 | Auerbach . | |
| 4,955,965 | 9/1990 | Mandel . | |
| 4,967,899 | 11/1990 | Newsome . | |
| 4,983,990 | 1/1991 | Frohlich . | |
| 5,004,220 | 4/1991 | Dreschel et al. . | |
| 5,012,915 | 5/1991 | Kristola et al. . | |
| 5,056,772 | 10/1991 | Kellum, III . | |
| 5,090,683 | 2/1992 | Kamath et al. . | |
| 5,101,960 | 4/1992 | Simons . | |
| 5,106,070 | 4/1992 | Reist . | |
| 5,112,041 | 5/1992 | Honegger . | |
| 5,114,137 | 5/1992 | Olson . | |
| 5,169,489 | 12/1992 | Kalisiak et al. | 271/186 X |
| 5,172,907 | 12/1992 | Kalisiak . | |
| 5,180,154 | 1/1993 | Malick . | |
| 5,180,159 | 1/1993 | Malick . | |
| 5,188,355 | 2/1993 | Lowell et al. . | |
| 5,205,551 | 4/1993 | Nagano et al. . | |
| 5,224,696 | 7/1993 | Kellum, III . | |

(List continued on next page.)

FOREIGN PATENT DOCUMENTS

| | | | |
|---|---|---|---|
| 0242865 | 10/1988 | European Pat. Off. . | |
| 3045359 | 7/1982 | Germany | 271/186 |
| 2152845 | 6/1990 | Japan | 271/186 |

*Primary Examiner*—David H. Bollinger
*Attorney, Agent, or Firm*—Roberts & Mercanti, LLP

[57] ABSTRACT

The present invention discloses an article orienting apparatus for use in a printing process. The apparatus includes a power roller inclined at an acute angle to the article path for wrappingly receiving an article. The article is moved from a first orientation to a second orientation. The apparatus further includes a second drum for inverting the moving articles.

18 Claims, 5 Drawing Sheets

U.S. PATENT DOCUMENTS 5,259,606 11/1993 Takahashi .
5,282,528 2/1994 Hudson .
5,295,679 3/1994 Reist ..... 271/186 X
5,318,285 6/1994 Edwards et al. .
5,320,340 6/1994 Bay .
5,333,851 8/1994 Kulpa .
5,358,234 10/1994 Boriani et al. .
5,362,039 11/1994 Kusters .
5,411,250 5/1995 Belec et al. ..... 271/185
5,413,326 5/1995 Wright .
5,433,430 7/1995 Straessler et al. .
5,443,254 8/1995 Reist .

APPARATUS AND METHOD FOR TURNING AND ORIENTING ARTICLES WITHIN AN ARTICLE PATHWAY

CROSS REFERENCE TO RELATED APPLICATION

This application is a continuation in part of U.S. patent application Ser. No. 08/539,836, filed on Oct. 6, 1995, now U.S. Pat. No. 5,695,185, which is incorporated herein by reference.

BACKGROUND OF THE INVENTION

1. Field of the Invention

The present invention relates generally to a method and apparatus for re-orienting articles as they move between an input and output portion of an article handling system. More particularly, in the preferred embodiment the present invention relates to an article handling system utilized in a printing process.

2. Description of the Prior Art

Web printing is one type of printing process that can utilize an article handling system for re-orienting articles. Web printing is a high speed process that involves printing from a continuous web(s) of paper, merging web(s), cutting the web(s), and folding the resulting cut product into individual articles known as signatures. The resulting signatures are delivered onto a moving conveyor in a lapped or shingled arrangement to create a continuous stream of signatures. With the recent advancements in technology, modem web printing can deliver an output in access of 100,000 signatures per hour. A signature can either be a finished product such as an advertisement, or a subcomponent of a larger product that in a later step will be merged and bound into a final finished product. Depending on the particular requirements of the specific signature, they may require additional finishing such as gluing, stapling, and trimming.

A typical finishing process for signatures cut from a moving web(s) is to trim three sides of the signature. Prior designers of finishing systems for web printing have generally utilized rotary knives to trim the edges of the signatures. In the prior trimming process a signature is separated from the shingled arrangement of signatures and passed through a set of rotary knives to trim two of the opposed edges of the signature. Upon the signature exiting from the rotary knives it is directed against a fixed stop which is generally known as a "bump turn" and then dropped onto a power conveyor oriented at a ninety degree angle from the trimming process. This power conveyor delivers the signature to a third rotary knife station, wherein a third edge of the signature is trimmed. Historically, this had been the generally accepted manufacturing technique to produce a finished signature, however, throughput from this type of finishing system is limited to 15,000 signatures per hour. In view of the higher speed requirements of today's web systems an output of 15,000 signatures per hour is unacceptable.

In response to the improvements in web printing systems and the associated requirement for higher throughput, engineers have developed improved rotary trimmers to allow the signatures to remain in a shingled stream and thereby increase the finishing station. Refinements to the "bump turn" are generally known in the art and are generally comprised of a combination of angles, such as 30/60 degrees and 45/45 degrees all of which together produce a 90° final outcome for turning the signature.

Even with a variety of earlier designs there remains a need for an improved apparatus and method for turning and orienting articles within an article pathway. The present invention satisfies this need in a novel and unobvious way.

SUMMARY OF THE INVENTION

To address the unmet needs of prior article handling systems, the present invention contemplates an apparatus for re-orienting moving articles from a first orientation to a second orientation. The apparatus comprises an article pathway; and a rotatable re-orienting drum positioned within the pathway and oriented with its axis of rotation at an acute angle to the pathway for re-orienting the articles from the first orientation to the second orientation while the articles pass around at least a portion thereof.

The invention provides an apparatus for reorienting a continuous moving stream of flat, flexible articles having an obverse side and a reverse side and which have a head to tail orientation, which apparatus comprises a conveyor belt capable of moving a stream of flat, flexible articles in a first linear direction, said conveyor belt being wrapped around arcuate path means; means for placing the stream of articles on the conveyor belt such that the articles are initially transported on the conveyor belt in the first linear direction and then moved between the arcuate path means and the conveyor belt such that the articles are repositioned from a first orientation with the obverse side upward and moving in a head to tail orientation in the first linear direction, to an inverted orientation with the reverse side upward and moving in a head to tail orientation, such that the articles are thereafter spaced from and move in a transient direction opposite to the first linear direction.

The invention also provides an apparatus for reorienting a continuous moving stream of flat, flexible articles having an obverse side and a reverse side and which have a head to tail orientation and move in a transient direction, which apparatus comprises a conveyor belt which is wrapped around arcuate path means; means for placing the stream of articles on the conveyor belt such that the articles move between the arcuate path means and the conveyor belt such that the articles are turned and repositioned from an orientation with the reverse side upward and moving in a head to tail orientation to an inverted orientation with the obverse side upward and in a head to tail orientation, such that the articles are thereafter spaced from and reoriented to a position at an angle to the transient direction.

The invention further provides a combined apparatus for reorienting a continuous moving stream of flat, flexible articles having an obverse side and a reverse side and which have a head to tail orientation, which apparatus comprises (a) a first conveyor belt capable of moving a stream of flat, flexible articles in a first linear direction, said first conveyor belt being wrapped around first arcuate path means; means for placing the stream of articles on the first conveyor belt such that the articles are initially transported on the first conveyor belt in the first linear direction and then moved between the first arcuate path means and the first conveyor belt such that the articles are repositioned from a first orientation with the obverse side upward and moving in a head to tail orientation in the first linear direction, to an inverted orientation with the reverse side upward and moving in a head to tail orientation, such that the articles are thereafter spaced from and move in a transient direction opposite to the first linear direction;

(b) a second conveyor belt which is wrapped around second arcuate path means; means for moving the stream of articles from the first conveyor belt onto the second conveyor belt such that the articles move between the second arcuate path means and the second conveyor belt such that the articles are turned and repositioned from an orientation with the reverse side upward and moving in a head to tail orientation to an inverted orientation with the obverse side upward and in a head to tail orientation, such that the articles are thereafter spaced from and reoriented to a position at an angle to the transient direction.

The invention still further provides a method for reorienting a continuous moving stream of flat, flexible articles having an obverse side and a reverse side and which have a head to tail orientation, which comprises (a) placing a stream of flat, flexible articles on a first conveyor belt moving in a first linear direction, said first conveyor belt being wrapped around first arcuate path means; moving the articles between the first arcuate path means and the first conveyor belt such that the articles are repositioned from a first orientation with the obverse side upward and moving in a head to tail orientation in the first linear direction, to an inverted orientation with the reverse side upward and moving in a head to tail orientation, such that the articles are thereafter spaced from and move in a transient direction opposite to the first linear direction;

(b) transferring the articles to a second conveyor belt which is wrapped around second arcuate path means; moving the articles between the second arcuate path means and the second conveyor belt and turning and repositioning the articles from an orientation with the reverse side upward and moving in a head to tail orientation to an inverted orientation with the obverse side upward and in a head to tail orientation, such that the articles are thereafter spaced from and move in a direction at an angle to the transient direction; and (c) stopping the moving of the articles in the direction at the angle to the transient direction with a bump fence; and (c) transporting the repositioned articles with additional conveyor means such that the articles are spaced from and move in a direction opposite to the transient direction.

One object of the present invention is to provide an improved apparatus for turning and orienting articles within an article pathway having these desirable attributes. Further objects and advantages of the present invention will be apparent from the following description.

DETAILED DESCRIPTION OF THE PREFERRED EMBODIMENT

Figure 1:
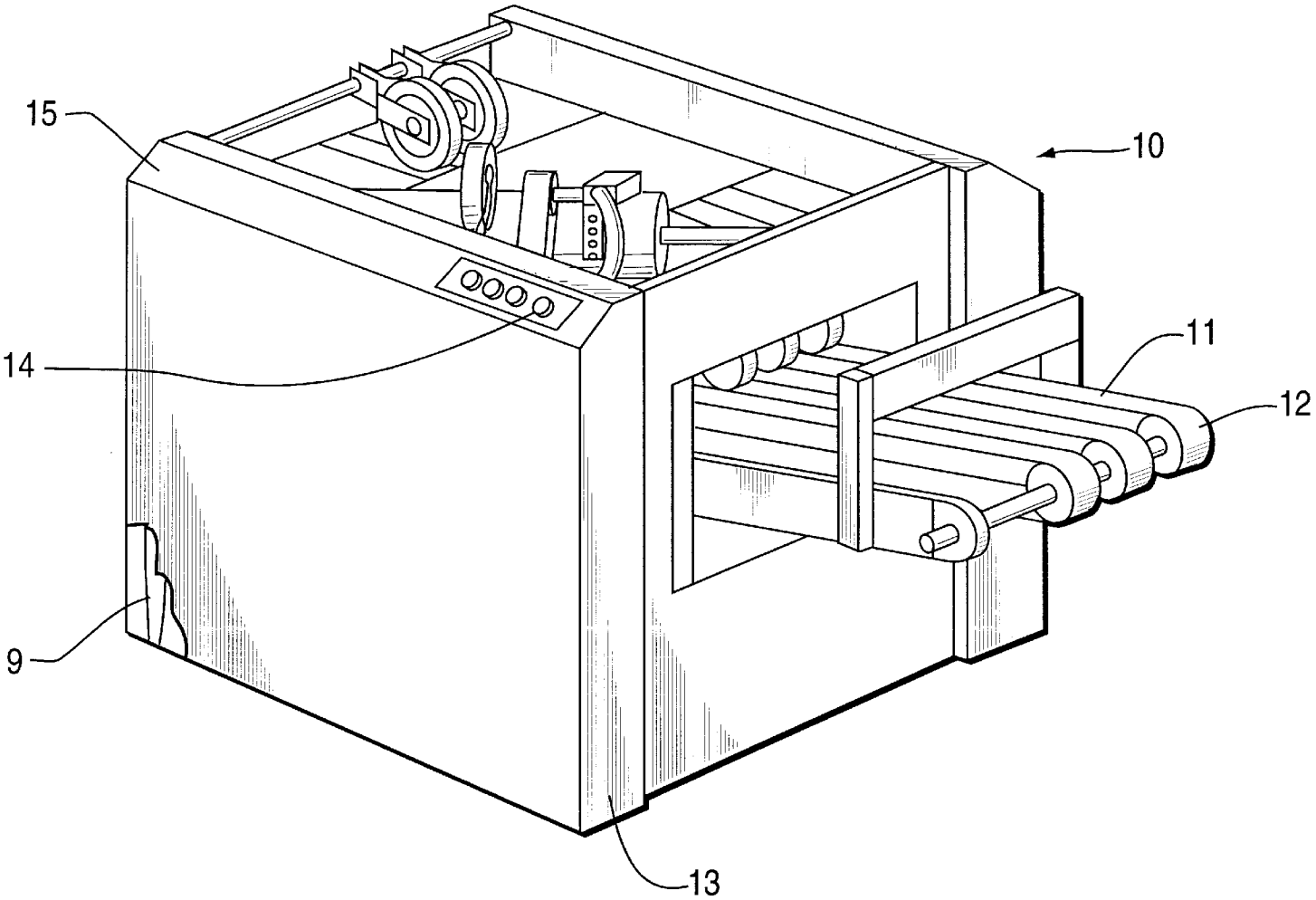
FIG. 1 is a perspective view of the apparatus for turning and re-orienting articles within a pathway according to one embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
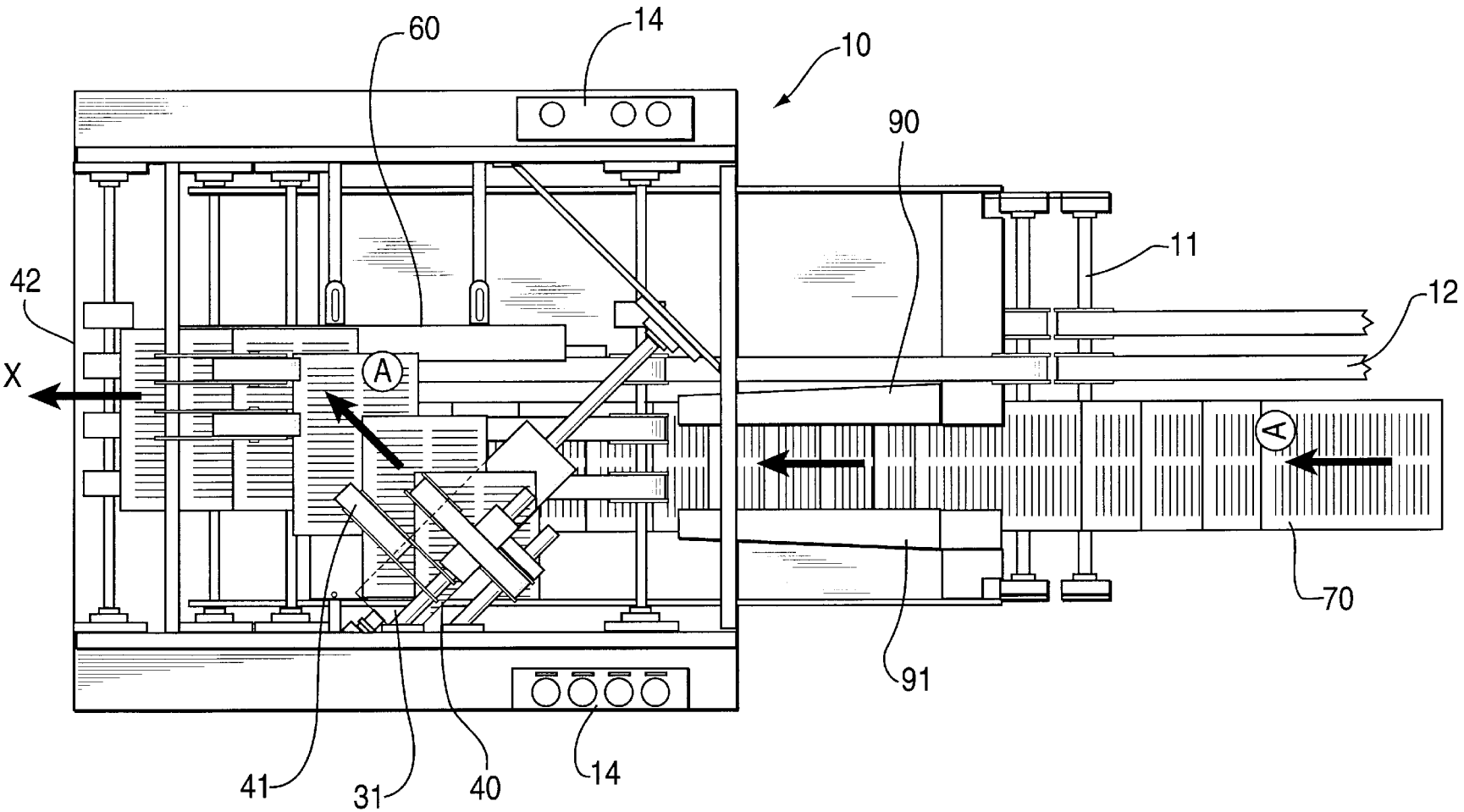
FIG. 3 is a top plan view of the apparatus of FIG. 1 for turning and re-orienting articles within a pathway.

Referring to FIG. 1, there is illustrated an apparatus 10 for turning and orienting articles within an article pathway. Hereinafter, the term article includes but is not limited to documents, envelopes, plain paper, folded paper and other similar material. Apparatus 10 is designed and manufactured in accordance with the present invention. A powered input conveyor 11 having a plurality of elastic belts 12 connected thereto provides the initial induction of the articles into the apparatus 10. The input conveyor 11 is attached to the structure of apparatus 10 and is designed for complete integration with an upstream output station from an article handling or printing system. The infrastructure of apparatus 10 comprises a frame 9 and external covers 13. In the preferred embodiment the frame 9 and covers 13 are formed of sheet metal, however they can also be formed from other materials that have sufficient properties to provide structural rigidity and safety enclosure for apparatus 10, such as castings, a welded fabrication and injection molding. An operator control panel 14 is positioned on each side of the apparatus 10 (FIG. 3).

Figure 2:
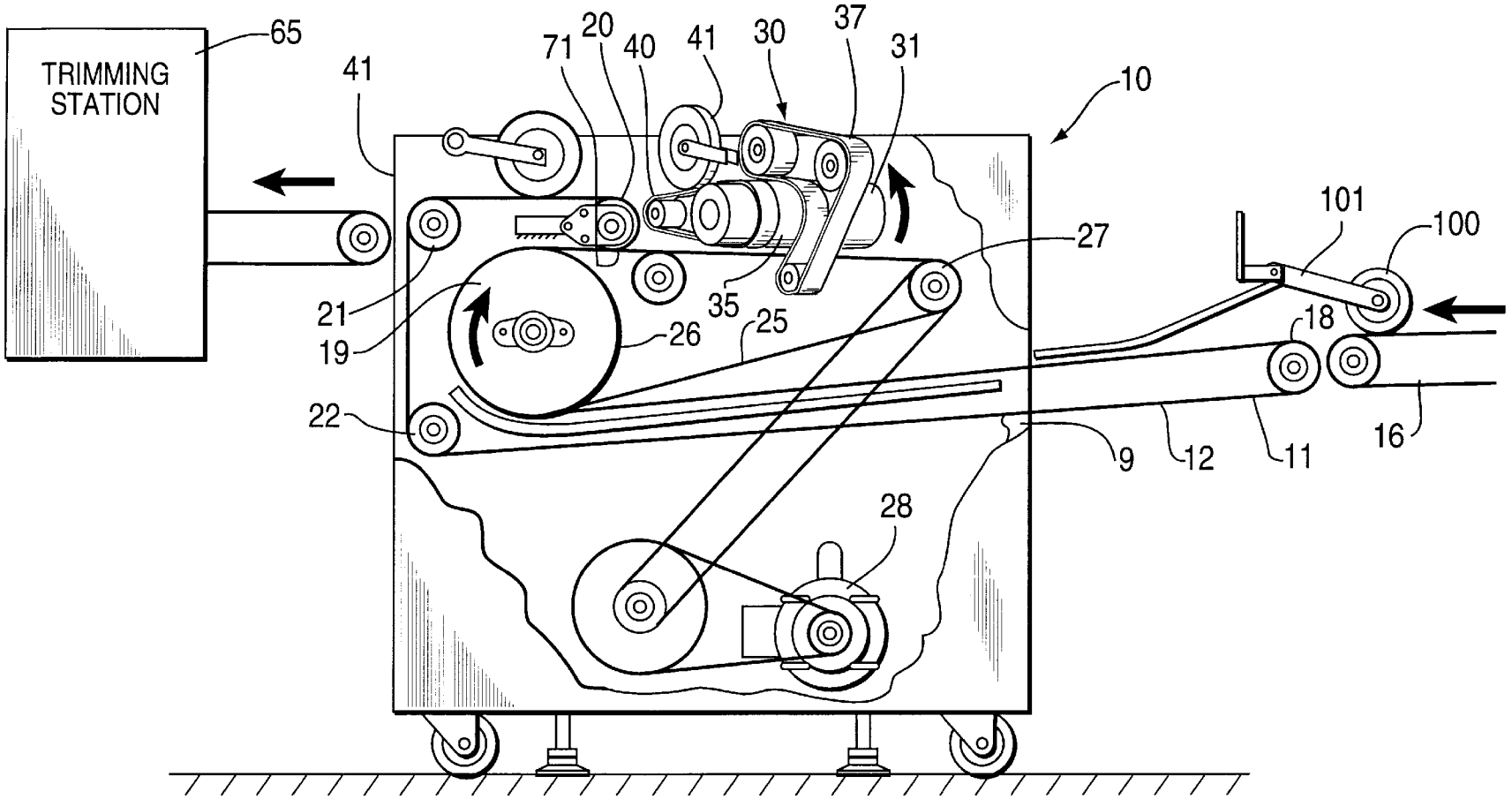
FIG. 2 is an illustrative side elevational view of the FIG. 1 apparatus for turning and re-orienting articles within a pathway.

With reference to FIG. 2, there is a fragmented illustrative side elevational view of apparatus 10. An exit conveyor 16 provides the pathway from the upstream process directly into the article pathway of apparatus 10. The input conveyor 11, which may be disposed horizontal or inclined, receives and conveys articles that are separated from one another or joined as in a lapped or shingled stream. The stream of articles in the preferred embodiment are continuously conveyed at a constant speed through the article pathway. An encoder 100 is connected to the apparatus 10 through a member 101. People of ordinary skill in the art recognize that the encoder is utilized to set the timing of the apparatus 10.

Figure 4:
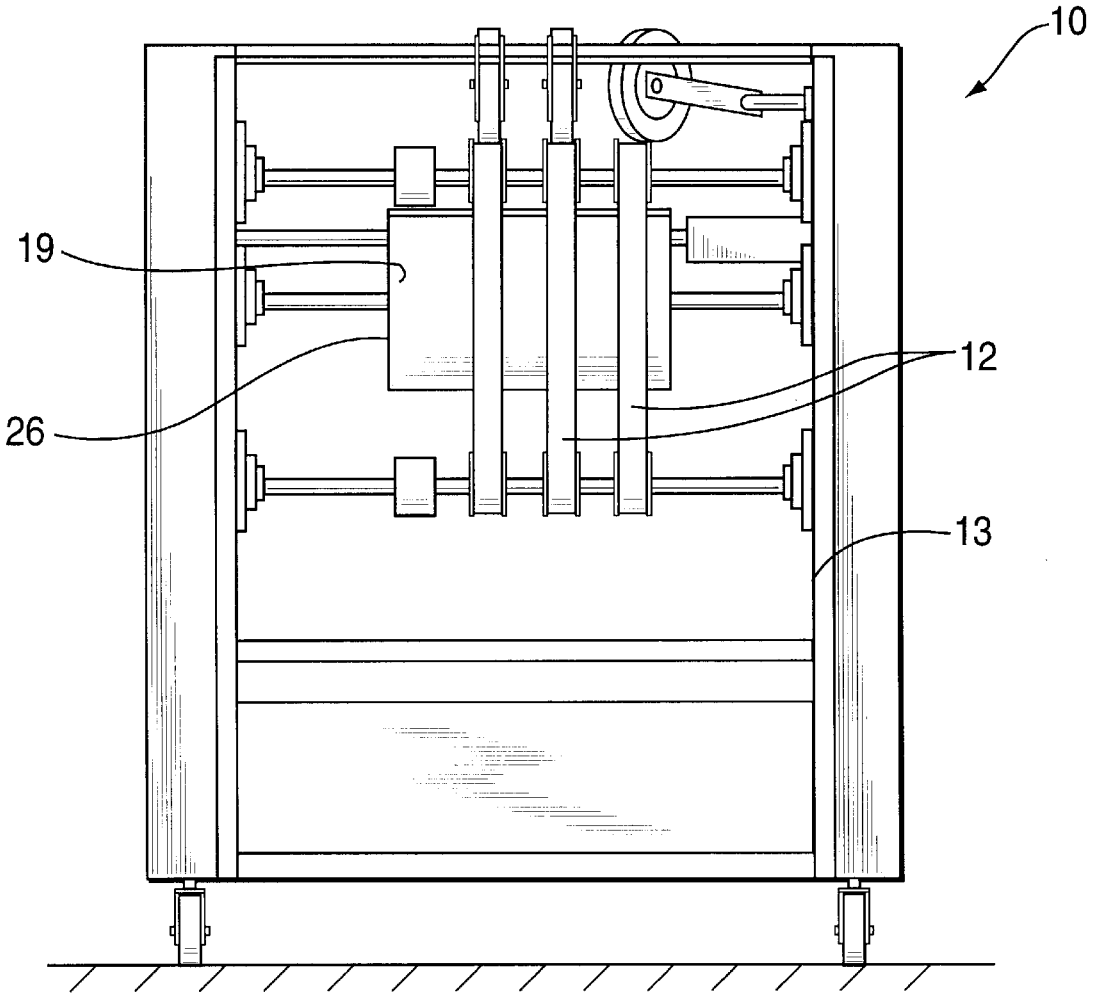
FIG. 4 is a end view of the apparatus of FIG. 1.
Figure 5:
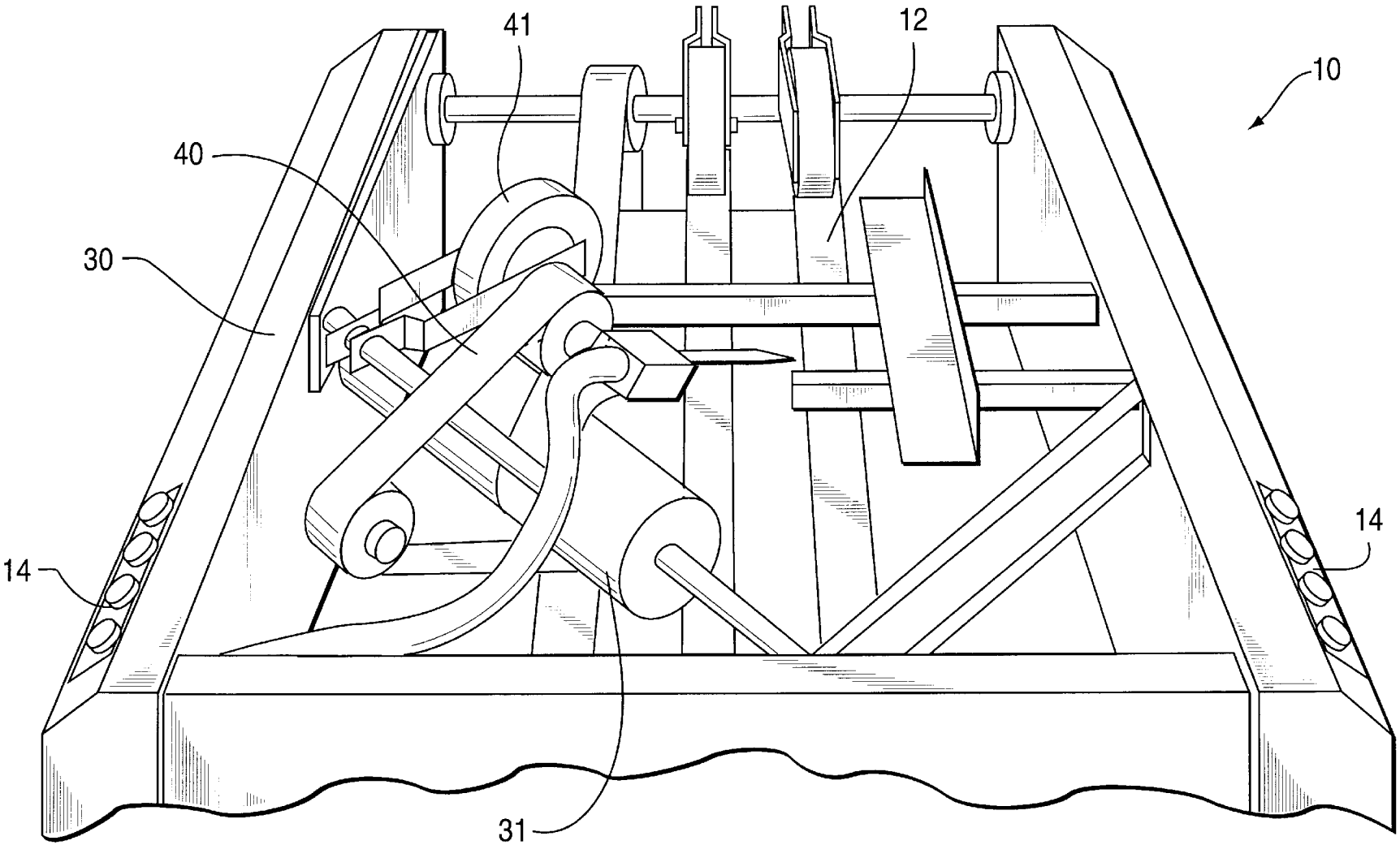
FIG. 5 is an enlarged partial perspective view of the FIG. 1 apparatus.

Input conveyor 11 having a plurality of elastic belts 12 that stretch from an initial reference point 18 and pass around an arcuate path which is preferably about 180° of a cylindrical turning drum 19, around a roller 20, and continue around two idlers 21 and 22 and then back to the initial reference point 18. In the preferred embodiment the elastic belts 12 are spaced laterally from one another (FIG.4), however a solid belt substantially the width of the article path and formed of alternative materials is contemplated herein. Input conveyor 11 is powered by a central drive motor 28, however distributed power is also contemplated in the present invention. The coupling of the drive motor to the conveyor is within the knowledge of people skilled in this art.

In the preferred embodiment, the arcuate path 19 is a cylindrical drum, however, it may also be a chute, a conical member, or one or more rollers. Cylindrical turning drum 19 is rotatably mounted to the frame 13, and in the preferred embodiment rotates in a clockwise direction indicated by arrow A. In the preferred embodiment the turning drum has an outside diameter of approximately ten inches. It is contemplated that the turning drum would have an outside diameter within a range of about ten to thirty-six inches. Turning drum 19 extends across the article pathway and has a plurality of elastic drive belts 25 wrapped around about 180 degrees of its circumference. Elastic article drive belts 25 that are analogous to belts 12 extend around drum 19 and roller 27. It is understood by those skilled in the art that other types of article drive belts are contemplated by the present invention.

The article elastic drive belts 25 are spaced across the article pathway and contact an outer circumferential surface 26 of the drum 19. The elastic drive belts 25 form a continuous path between the drum 19 and the roller 27. Roller 27 is a drive roller that is connected to the main drive motor 28 of apparatus 10. In the preferred embodiment this connection is by a drive belt, however other means are contemplated herein.

The elastic article drive belts 12 form a portion of the input conveyor 11 and are spaced radially outward from the elastic drive belts 25 that contact the outer surface 26 of the turning drum 19. The input conveyor article drive belts 12 and article drive belts 25 are aligned and in registry in order to minimize the wrinkling and creasing of articles passing therebetween. As the stream of articles enters the apparatus 10 they are conveyed by the input conveyor 11 to the drum 19 where they are rotated 180° around the drum, thereby inverting the article such that its reverse as opposed to its obverse side is upward; and continuing it along the pathway to a re-orienting portion 30.

The re-orienting portion 30 includes a powered drive roller 31 that is rotatable in the preferred embodiment in a counter clockwise direction. However, alternate embodiments contemplate rotation in other directions. The apparatus 10 in FIGS. 1–5, illustrates a clockwise rotation device (referring to the rotation of the article), however a counterclockwise rotation apparatus (referring to the rotation of the article) is contemplated in another form of the present invention. The counterclockwise rotation apparatus is configured as a mirror image of the reorienting portion about an axial centerline X. The re-orienting roller 31 is positioned at an acute angle to the article pathway formed by the drive belts 25. In the preferred embodiment the axis of rotation of the re-orienting roller 31 is disposed at an acute angle of about 45° to the article pathway as it traverses the direction of drive belt 25. Re-orienting roller 31 is substantially cylindrical and is driven by the main motor 28. In the preferred embodiment the outer surface of roller 31 is substantially smooth, however it is contemplated that a roughened surface may be necessary for certain articles. A knurled surface is utilized in one embodiment for article having a non heat set ink applied thereto. Power transmission from the roller 31 to the main drive motor 28 is accomplished by a drive belt, however other power transmission means as generally known to those skilled in the art is contemplated herein. In the preferred embodiment the re-orienting roller 31 is driven-at a sufficient speed such that the horizontal component of the articles' velocity remains substantially the same throughout the entire article pathway.

In order to maintain the stream of signatures in an overlapping configuration, the velocity of the signatures must be maintained constant throughout its path from input end 18, around belts 12, and around the re-orienting portion 30. Therefore, roller 31 must be driven at a velocity whose horizontal component equals the velocity of the incoming signature stream on belts 12. The plurality of elastic drive belts 25 convey the inverted moving article from the drum 19 to the angled re-orienting roller 31. A pinchpoint 35 is formed where the friction belt 37 wraps around 180° of the re-orienting roller 31. The friction belt 37 is mounted on rollers and is driven by the rotating roller 31. At pinchpoint 35 the article is engaged by moving roller 31 and driven wrappingly around the outer surface of the cylindrical roller 31. In the preferred embodiment the roller has about a four inch diameter and the article follows a helical path around the roller. Alternative forms of the present invention contemplate rollers having other outside diameters to meet the particular needs of the article. During the movement of the article around the roller 31 an edge A (FIG.3) is re-oriented such that it is rotated ninety degrees from its first position.

An elastic belt 40 and kicker wheel 41 are connected to the re-orienting drum 31. Drive belt 40 and kicker wheel 41 function to ensure that the articles leaving the roller 31 arrive at their second re-orienting position completely abutted against a bump fence, or stop 60. Any articles that do not come to rest completely against the stop 60 are urged by belt 40 and kicker 41 into the second re-orienting position. Upon exiting the re-orienting portion 30 of article 10 the articles continue to travel along the article pathway to the output side 42 of apparatus 10. The article pathway to the exit point is a continuation of the moving belts 12, which have a plurality of tension wheels disposed thereat. As shown in FIG. 3, stop 60 is positioned parallel to the direction indicated by arrow X. The stop serves to maintain the component of the signature's velocity in the direction of the X arrow while removing the velocity component perpendicular to the X arrow direction. It is also contemplated by this invention that the stop can be positioned at any other angle to facilitate movement of the signature stream at any desired direction.

From the output side 42 of the apparatus 10 the articles are able to be conveyed to another workstation 65 for further processing. The additional downstream workstations include trimming stations, wind-up reels, ink-jet printing, and stackers. The wind up reels are distributed by Ferag/rmo of Bristol, Pa. under the tradename MINIDISK and Muller Martini of Smithtown, N.Y. under the tradename PRINT-ROLLS.

Referring to FIG. 3, there is illustrated a top plan view of apparatus 10. The input conveyor 11 receives a plurality of shingled articles 70 that are moving at a high rate of speed, in one embodiment in the range of about 100–400 ft/minute. Point A indicates the head of the obverse side of a signature. A pair of spaced input stream guides 90 and 91 are positioned on each side of the stream of articles. In an alternative form of the present invention the streamguides 90 and 91 are replaced with stream aligners that are utilized to remove crookedness or unevenness in the stream. The utilization of stream aligners to straighten a stream is generally known to people skilled in the art.

The input articles 70 are conveyed through the article pathway in a continuous, uninterrupted fashion and are inverted at drum 19. Upon exiting drum 19 a pinchpoint 71 prevents the trailing articles from being fed into the roller 31. In an alternative form of the present invention the pinchpoint 71 is comprised of an adjustable structure which allows the pinchpoint to be adjusted to accommodate different article lengths. The articles continue uninterrupted to the re-orienting portion 30 where they are wrapped around the roller 31, and have their head to tail orientation moved 90 degrees. If the article is not completely located against stop 60 the kicker wheel 41 and drive belt 40 urge the article thereagainst. Further, re-orienting roller 31 is moveable along its axis of rotation to adjust to different sizes of articles. A mechanical affixation such as a clamping device is utilized to lock it in place.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. An apparatus for reorienting a continuous moving stream of flat, flexible articles having an obverse side and a reverse side and which have a head to tail orientation and move in a transient direction, which apparatus comprises a conveyor belt which is wrapped around arcuate path means; means for placing the stream of articles on the conveyor belt such that the articles move between the arcuate path means and the conveyor belt such that the articles are turned and repositioned from an orientation with the reverse side upward and moving in a head to tail orientation to an inverted orientation with the obverse side upward and in a head to tail orientation, such that the articles are thereafter spaced from and reoriented to a position at an angle to the transient direction; additional conveyor means which receive and transport the repositioned articles wherein the additional conveyor means transports the repositioned articles spaced from and in a direction opposite to the transient direction.

2. The apparatus of claim 1 wherein the arcuate path means comprises a rotatable, cylindrical drum.

3. The apparatus of claim 1 wherein the angle is about 90 degrees.

4. The apparatus of claim 1 which comprises a bump fence which stops the moving of the articles in the direction at an angle to the transient direction prior to the additional conveyor means receiving and transporting the repositioned articles.

5. The apparatus of claim 1 wherein the arcuate path means comprise a cylindrical drum, a chute, a conical member, or one or more rollers.

6. An apparatus for reorienting a continuous moving stream of flat, flexible articles having an obverse side and a reverse side and which have a head to tail orientation, which apparatus comprises (a) a first conveyor belt capable of moving a stream of flat, flexible articles in a first linear direction, said first conveyor belt being wrapped around first arcuate path means; means for placing the stream of articles on the first conveyor belt such that the articles are initially transported on the first conveyor belt in the first linear direction and then moved between the first arcuate path means and the first conveyor belt such that the articles are repositioned from a first orientation with the obverse side upward and moving in a head to tail orientation in the first linear direction, to an inverted orientation with the reverse side upward and moving in a head to tail orientation, such that the articles are thereafter spaced from and move in a transient direction opposite to the first linear direction;

(b) a second conveyor belt which is wrapped around second arcuate path means; means for moving the stream of articles from the first conveyor belt onto the second conveyor belt such that the articles move between the second arcuate path means and the second conveyor belt such that the articles are turned and repositioned from an orientation with the reverse side upward and moving in a head to tail orientation to an inverted orientation with the obverse side upward and in a head to tail orientation, such that the articles are thereafter spaced from and reoriented to a position at an angle to the transient direction.

7. The apparatus of claim 6 wherein said first and second arcuate paths each comprise a rotatable, cylindrical drum.

8. The apparatus of claim 6 wherein the angle is about 90 degrees.

9. The apparatus of claim 6 further comprising additional conveyor means which receive and transport the repositioned articles.

10. The apparatus of claim 9 wherein the additional conveyor means transports the repositioned articles spaced from and in a direction opposite to the transient direction.

11. The apparatus of claim 9 which comprises a bump fence which stops the moving of the articles in the direction at an angle to the transient direction prior to the additional conveyor means receiving and transporting the repositioned articles.

12. The apparatus of claim 6 wherein the first and second arcuate path means independently comprise a cylindrical drum, a chute, a conical member, or one or more rollers.

13. A method for reorienting a continuous moving stream of flat, flexible articles having an obverse side and a reverse side and which have a head to tail orientation, which comprises (a) placing a stream of flat, flexible articles on a first conveyor belt moving in a first linear direction, said first conveyor belt being wrapped around first arcuate path means; moving the articles between the first arcuate path means and the first conveyor belt such that the articles are repositioned from a first orientation with the obverse side upward and moving in a head to tail orientation in the first linear direction, to an inverted orientation with the reverse side upward and moving in a head to tail orientation, such that the articles are thereafter spaced from and move in a transient direction opposite to the first linear direction;

(b) transferring the articles to a second conveyor belt which is wrapped around second arcuate path means; moving the articles between the second arcuate path means and the second conveyor belt and turning and repositioning the articles from an orientation with the reverse side upward and moving in a head to tail orientation to an inverted orientation with the obverse side upward and in a head to tail orientation, such that the articles are thereafter spaced from and move in a direction at an angle to the transient direction; and (c) stopping the moving of the articles in the direction at the angle to the transient direction with a bump fence; and (c) transporting the repositioned articles with additional conveyor means such that the articles are spaced from and move in a direction opposite to the transient direction.

14. The method of claim 13 wherein the stream of articles is a shingled stream of partially overlapping articles.

15. The method of claim 13 wherein the articles are comprised of paper.

16. The method of claim 13 wherein said first and second arcuate paths each comprise a rotatable, cylindrical drum.

17. The method of claim 13 wherein the angle is about 90 degrees.

18. The apparatus of claim 13 wherein the first and second arcuate path means independently comprise a cylindrical drum, a chute, a conical member, or one or more rollers.

* * * * *